US005928051A

United States Patent [19]

Krog

[11] Patent Number: 5,928,051

[45] Date of Patent: Jul. 27, 1999

[54] TOY BUILDING SET WITH TWO COMPLEMENTARY TOY BUILDING ELEMENTS

[75] Inventor: Ricco Reinholdt Krog, Vejen, Denmark

[73] Assignee: INTERLEGO AG, Baar, Switzerland

[21] Appl. No.: 09/040,726

[22] Filed: Mar. 18, 1998

[51] Int. Cl.[6] ..... A63H 33/12; A63H 33/08

[52] U.S. Cl. ..... 446/104; 446/126; 446/120

[58] Field of Search ..... 446/124, 126, 446/102, 103, 104, 120, 121, 122, 128

[56] References Cited

U.S. PATENT DOCUMENTS

| | | | |
|---|---|---|---|
| 1,843,115 | 2/1932 | Ferris | 446/126 |
| 2,218,175 | 10/1940 | Mack | 446/120 |
| 2,410,874 | 11/1946 | Greenberg et al. | 446/426 |
| 4,044,497 | 8/1977 | Bettens . | |
| 4,209,934 | 7/1980 | Ogawa | 446/122 X |
| 4,844,648 | 7/1989 | Fentiman . | |
| 5,030,103 | 7/1991 | Buist et al. | 446/126 X |
| 5,769,681 | 6/1998 | Greenwood, Sr. et al. | 446/120 |

*Primary Examiner*—D Neal Muir

*Attorney, Agent, or Firm*—Kane,Dalsimer,Sullivan, Kurucz, Lavy, Eisele and Richard, LLP

[57] ABSTRACT

A toy building set comprising toy building elements provided with complementary coupling members, said toy building set comprising a first toy building element (1) having a through-going opening (3) and with coupling members (4) arranged in a plane perpendicular to the through-going opening (3), and a second, elongate toy building element (2) having an outer cross section that fits into the cross section of the through-going opening (3) in the first toy building element (1). The second toy building element (2) is provided with coupling members (4), at least at the one end, and securing members are provided for temporarily securing the second toy building element (2) in the first toy building element (1).

7 Claims, 2 Drawing Sheets

TOY BUILDING SET WITH TWO COMPLEMENTARY TOY BUILDING ELEMENTS

BACKGROUND OF THE INVENTION

1. Field of the Invention

The invention relates to a toy building set comprising toy building elements provided with complementary coupling means, said toy building set comprising a first toy building element with a through-going opening and having coupling means arranged in a plane perpendicular to said through-going opening, said toy building set further comprising a second elongate toy building element with an outer cross section that fits into the cross section of the through-going opening in the first toy building element.

2. Description of the Related Art

Such toy building element is known from the toy building kit known as 'Construx' which features a toy building element used as connector for other bar-shaped toy building elements. The connector element is cubic and it is on four faces provided with protruding male coupling means in the form of square undercut heads that are able to engage with complementary openings provided in said bar-shaped toy building elements. The four male coupling means are arranged in the same plane whereas the remaining two parallel faces without male coupling means are provided with a through-going cylindrical opening for mounting of e.g. a shaft. Thus, this toy building element is suitable for the building of a two-dimensional construction, optionally having a shaft in the third dimension.

The same toy building kit features a hinge element that consists of two elements that are rotatably mounted relative to each other. Each element is provided with a male coupling means, and the hinge element is configured with a through-going cylindrical opening in the pivotal joint. Furthermore, at connector element is known which, in principle, corresponds to the first-mentioned connector element but having protruding male coupling means on all six faces. This element is used if it is desired to build a three-dimensional construction. The two latter toy building elements are also known from U.S. Pat. No. 4,044,497.

Thus, the two first-mentioned toy building elements are intended for the building of a two-dimensional structure, whereas the latter is intended for the building of a three-dimensional structure. If the latter toy building element is used in the construction of two-dimensional structures, the coupling means perpendicular to the structure will be redundant and further prevent the building of completely planar structures. In this case these toy building elements are superfluous and usually they will not be part of the game.

SUMMARY OF THE INVENTION

It is the object of the present invention to provide a toy building set containing toy building elements that may, according to choice, be used for the construction of two- or three-dimensional structures without making any of the toy building elements superfluous.

This is obtained by configuring the toy building set described in the introductory part as featured in the characterising part of claim 1.

It is hereby obtained that the first toy building element as well as the second toy building element can be used for the construction of two-dimensional structures, and that it is furthermore possible to interconnect the two toy building elements to form a connector element with coupling means in three dimensions.

According to a preferred embodiment, the cross section of the through-going opening of the first toy building element as well as the cross section of the second, elongate toy building element are square. This imparts a very simple configuration to the toy building elements, and they may easily be so configured that their dimensions fit into a modular dimension which is typical for the toy building set.

The securing means for temporarily securing the second toy building element in the through-going opening in the first toy building element is preferably in the form of protruding beads on the second toy building element.

According to a particularly preferred embodiment, the first toy building element is provided with four mutually perpendicularly protruding male coupling means whereas the second, elongate toy building element is provided with a male coupling means at each end. When two such toy building elements are interconnected by the second toy building element being shifted into the through-going opening of the first toy building element, a combined toy building element is obtained that may serve as a three-dimensional connector element for further toy building elements.

The first toy building element does not have to be provided with fixed coupling means but may be provided with at least one coupling means mounted rotatably around the through-going opening, and according to a preferred embodiment of this toy building element, the through-going opening is provided in a central portion around which at least two coupling means are rotatably mounted, e.g. by the central portion consisting of an annulus with at least two annular grooves, wherein each of said coupling means is provided in an annular portion arranged in one of the grooves of the central portion. Such toy building element affords additional building options since it permits structures to be built that contain pivotal parts.

BRIEF DESCRIPTION OF THE DRAWINGS

The invention will now be explained in further detail with reference to the drawings, wherein.

DETAILED DESCRIPTION OF THE INVENTION

Figure 1:
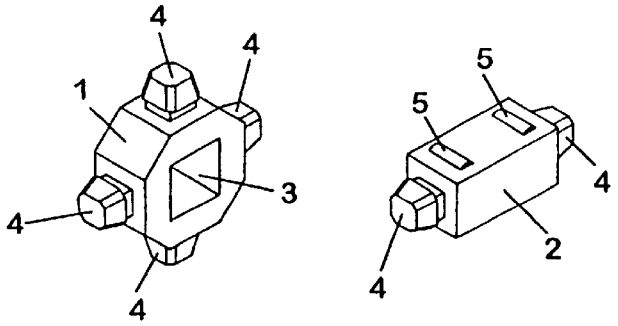
FIG. 1 illustrates a preferred embodiment of a first and a second toy building element.
Figure 2:
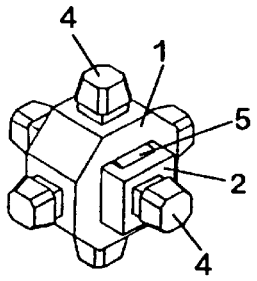
FIG. 2 illustrates the toy building elements shown in FIG. 1 in their interconnected state.

FIG. 1 illustrates a first toy building element 1 and a second toy building element 2 according to the invention. In the embodiment shown, the first toy building element has a generally octagonal appearance with a square through-going opening 3 and four mutually perpendicularly arranged coupling tenons 4. The second toy building element 2 is configured as an elongate, bar-shaped toy building element with a coupling tenon at both ends. The cross section of the bar-shaped toy building element 2 is square with the same dimensions as the through-going opening 3 in the toy building element 1 whereby the toy building element can be shifted into the through-going opening 3 in the first toy building element 1, as shown in FIG. 2.

The bar-shaped toy building element 2 is provided with four beads 5 that are arranged in twos on opposite sides at a mutual distance that corresponds to the width of the first toy building element 1. When the bar-shaped toy building element 2 is shifted into the through-going opening in the toy building element 1, it will be temporarily secured in this position by snap-locking, since said beads 5 engage on each side of the toy building element 1 as shown in FIG. 2. Thus, it requires a certain force to provide this temporary securing, viz. when the bar-shaped toy building element 2 in combination with two of the beads 5 are pressed through the through-going opening 3, and it also takes a certain amount of force to subsequently separate the two toy building elements 1,2. The combined toy building element shown in FIG. 2 may thus be considered a stable toy building element that can only be dismantled with a certain effort.

Figure 3:
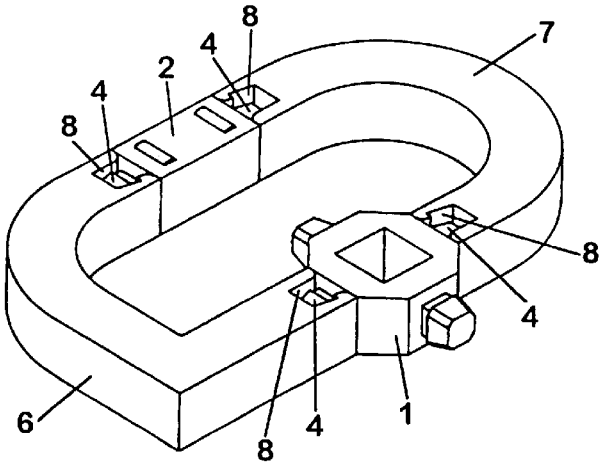
FIG. 3 illustrates the use of a first and a second toy building element in a plane structure.

The toy building elements 1 and 2 can each be used in combination with other toy building elements 6 and 7 for the formation of two-dimensional structures as shown in FIG. 3.

In FIG. 3 the toy building elements 1 and 2 are combined with two other toy building elements 6 and 7 to form a two-dimensional structure in the form of a closed annulus. As will appear, the toy building elements 6 and 7 are provided at their ends with female coupling means 8 that may engage with the tenons 4 on the toy building elements 1 and 2. How the male coupling means 4 and the female coupling means 8 are configured will not be subject to detailed discussion herein, but they may preferably be substantially square, undercut tenons as shown that may engage in a non-rotatable manner with slots having complementary barbs.

FIG. 3 shows how the toy building elements 1 and 2 may be part of a completely planar structure in which no parts of the constituent toy building elements 1,2,6 and 7 protrude beyond the plane.

Figure 4:
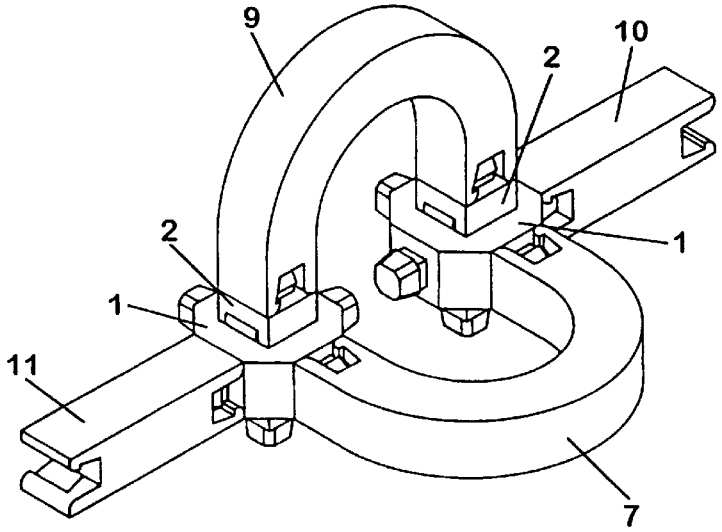
FIG. 4 illustrates the use of a first and a second toy building element in a three-dimensional structure.

If, on the other hand, it is desired to build a three-dimensional structure as shown in FIG. 4, the toy building elements 1 and 2 may be interconnected to form a combined toy building element as shown in FIG. 2. Hereby a connector element is provided having coupling means in the form of tenons 4 that protrude in three dimensions. This combined toy building element may be used as shown in FIG. 4 where it is part of a three-dimensional structure in combination with other toy building elements 7,9,10 and 11. The toy building elements 7,9,10 and 11 are interconnected with the toy building elements 1 and 2 in the same manner as the toy building elements 6 and 7 shown in FIG. 3.

Thus, it is possible by means of the same two two-dimensional toy building elements 1 and 2 to form a third three-dimensional toy building element that permits the construction of three-dimensional structures.

Figure 5:
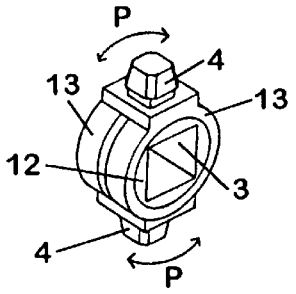
FIG. 5 illustrates an alternative embodiment of a first toy building element.

In FIGS. 1–4, the first toy building element 1 is depicted as a one-piece element with fixed coupling means in the form of four protruding tenons 4. An alternative embodiment of the first toy building element is shown in FIG. 5 that depicts a toy building element 11 having a through-going opening 3 and two tenons 4, that are rotatably arranged as indicated by the arrows P. In the embodiments shown, the tenons 4 are freely rotatable about the central portion of the toy building element 12, as they are each arranged on an annular portion 13 that as been snapped into an annular groove provided in the cylinder face (not shown) of the central portion.

Figure 6:
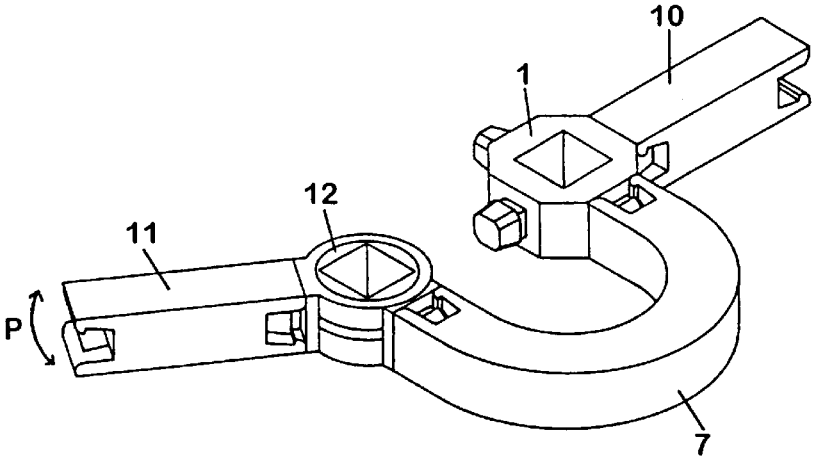
FIG. 6 illustrates the use of the toy building element shown in FIG. 5 in a plane structure.

FIG. 6 illustrates how the toy building element 12 may be part of a plane structure in combination with other toy building elements 1, 7, 10 and 11, and as will appear, it is possible with the toy building element 12 to build a structure with movable parts as indicated by the arrow P before the toy building element 11. Thus, the toy building element 11 is able to pivot appr. 250° about the toy building element 12.

Figure 7:
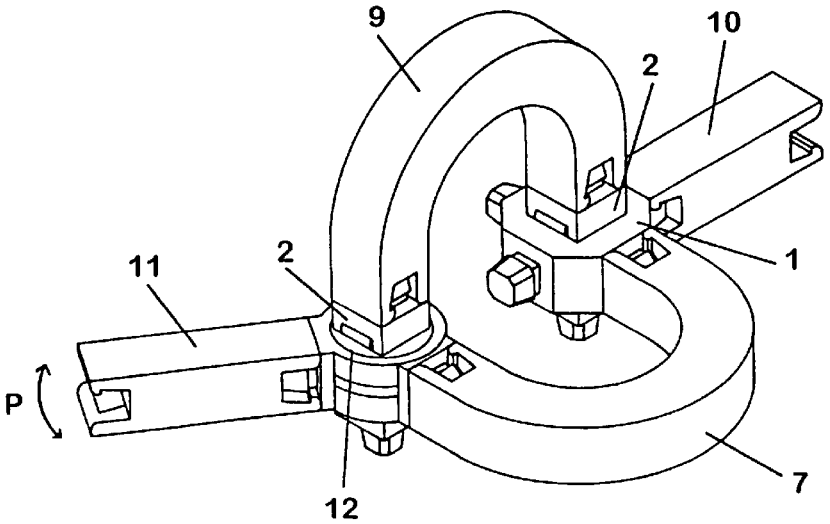
FIG. 7 illustrates the use of the toy building element shown in FIG. 5 and a second toy building element in a three-dimensional structure.

It will appear from FIG. 7 that the toy building element 12 can also be used for the construction of three-dimensional structures in the same manner as the toy building element 1 shown in FIGS. 1–4, but such that it is possible to incorporate facilities for pivoting movements as hinted by the arrow P.

When the toy building element 12 is used for the construction of three-dimensional structures, the toy building element 2 is shifted into the through-going opening 3 for temporary securing, following which other toy building elements 7,9 and 11 may be interconnected with the toy building element 11 for the construction of the desired structure with pivoting functions.

In the drawings, the toy building elements 1,2 and 12 are depicted with protruding male coupling means in the form of tenons 4, whereas the remaining toy building elements 6,7,9,10 and 11 are depicted with complementary female coupling means 8. However, nothing prevents the toy building elements 1,2 and 12 from being provided with female coupling means 8 while the remaining toy building elements 6,7,9,10 and 11 are provided with complementary, protruding male coupling means in the form of tenons 4. Any combination of male and female coupling tenons on the same toy building element is also an option.

Finally, the number and positioning of coupling means on the different toy building elements may be varied without hereby departing from the idea behind the invention, and likewise the actual embodiment of the toy building elements may differ from those shown.

I claim:

1. A toy building set having toy building elements provided with complementary coupling means, said toy building set comprising a first toy building element having a through-going opening and coupling means arranged in a plane perpendicular to the through-going opening, said toy building set further comprising a second, elongate toy building element with an outer cross section that fits into the through-going opening in the first toy building element, the second toy building element being provided with beads having an inclined forward face and being sufficiently yieldable for slidable insertion into and passage through the through-going opening for cooperating with edges of the through-going opening of the first toy building element in a snap action for releasably securing the second toy building element in the through-going opening of the first toy building element.

2. A toy building set according to claim 1, wherein the cross section of the through-going opening in the first toy building element is square, and wherein the cross section of the second, elongate toy building element is also square.

3. A toy building set according to claim 1, wherein the second elongate toy building element is provided with a male coupling means at each end.

4. A toy building set according to claim 1, wherein the first toy building element is provided with four mutually perpendicularly protruding male coupling means.

5. A toy building set according to claim 4, wherein the second elongate toy building element is provided at each end with a male coupling tenon, and wherein the distance between said tenons corresponds to the distance between two opposed male coupling means on the first toy building element.

6. A toy building set according to claim 1, wherein the first toy building element is provided with at least one coupling means that is rotatably mounted around the through-going opening.

7. A toy building set according to claim 6, wherein the through-going opening is provided in a central portion around which at least two coupling means are rotatably mounted.

* * * * *